US011847945B2

(12) United States Patent
Li

(10) Patent No.: US 11,847,945 B2
(45) Date of Patent: Dec. 19, 2023

(54) CIRCUIT FOR AGEING DISPLAY PANEL AND DISPLAY PANEL

(71) Applicants: HKC CORPORATION LIMITED, Shenzhen (CN); CHONGQING HKC OPTOELECTRONICS TECHNOLOGY CO., LTD., Chongqing (CN)

(72) Inventor: Wenxin Li, Chongqing (CN)

(73) Assignees: HKC CORPORATION LIMITED, Shenzhen (CN); CHONGQING HKC OPTOELECTRONICS TECHNOLOGY CO., LTD, Chongqing (CN)

( * ) Notice: Subject to any disclaimer, the term of this patent is extended or adjusted under 35 U.S.C. 154(b) by 0 days.

(21) Appl. No.: 17/752,870

(22) Filed: May 25, 2022

(65) Prior Publication Data

US 2022/0284840 A1 Sep. 8, 2022

Related U.S. Application Data

(62) Division of application No. 17/257,296, filed as application No. PCT/CN2018/120212 on Dec. 11, 2018, now Pat. No. 11,380,234.

(51) Int. Cl.
*G09G 3/00* (2006.01)

(52) U.S. Cl.
CPC ..... *G09G 3/006* (2013.01); *G09G 2320/043* (2013.01); *G09G 2330/08* (2013.01)

(58) Field of Classification Search
CPC ..... G09G 3/006; G09G 2320/043; G09G 2330/08; G09G 2320/0233; G09G 2330/028
See application file for complete search history.

(56) References Cited

U.S. PATENT DOCUMENTS

| | | | | |
|---|---|---|---|---|
| 9,805,648 | B2 * | 10/2017 | Kim | G09G 3/3233 |
| 2006/0077136 | A1 * | 4/2006 | Cok | G09G 3/3216 345/76 |
| 2016/0027382 | A1 * | 1/2016 | Chaji | G09G 3/006 345/212 |
| 2016/0035281 | A1 * | 2/2016 | Jeon | G09G 3/006 345/78 |
| 2016/0111054 | A1 * | 4/2016 | Wang | G09G 3/2011 345/98 |
| 2016/0118022 | A1 * | 4/2016 | Chun | G09G 3/2007 345/690 |
| 2016/0125802 | A1 * | 5/2016 | Lee | G09G 3/3233 345/212 |
| 2016/0125811 | A1 * | 5/2016 | Park | G09G 3/3258 345/694 |

(Continued)

*Primary Examiner* — Grant Sitta

(57) ABSTRACT

Provided herein is a circuit for ageing display panel, including an ageing signal input circuit, a power input circuit and a power output circuit, in which the ageing signal input circuit and the power input circuit are independently connected to the power output circuit, and the power output circuit is connected to a load; the ageing signal input circuit is configured to receive an ageing signal and output the ageing signal to the power output circuit; the power input circuit is configured to provide a supply voltage for the power output circuit; and the power output circuit is configured to output the received supply voltage to the load.

12 Claims, 5 Drawing Sheets

(56) References Cited

U.S. PATENT DOCUMENTS

| | | | | |
|---|---|---|---|---|
| 2016/0133195 | A1* | 5/2016 | Park | G09G 3/3225<br>345/694 |
| 2017/0206838 | A1* | 7/2017 | Gai | G09G 3/3258 |
| 2018/0061312 | A1* | 3/2018 | He | G09G 3/3233 |
| 2018/0218703 | A1* | 8/2018 | Lee | G09G 3/3696 |
| 2019/0156747 | A1* | 5/2019 | Nie | G09G 3/3233 |

* cited by examiner

CIRCUIT FOR AGEING DISPLAY PANEL AND DISPLAY PANEL

This application is a Divisional of U.S. patent application Ser. No. 17/257,296 filed on Dec. 30, 2020. This application claims priority to the Chinese Patent Application No. 201811324899.7 entitled "CIRCUIT for ageing display panel AND DISPLAY PANEL" filed with the National Intellectual Property Administration, PRC on Nov. 8, 2018, which is incorporated by reference in its entirety.

TECHNICAL FIELD

The present disclosure relates to a circuit for ageing display panel and the display panel.

BACKGROUND

The statements herein merely provide background information related to the present application and do not necessarily constitute the conventional art.

TFT-LCD (Thin Film Transistor Liquid Crystal Display) is one of the major forms of panel display, and has become an important display platform in modern ft and video products.

Due to the manufacturing process and materials for display panels, new display panel products are prone to brightness attenuation. Therefore, to prevent unqualified products, ageing can be needed for display panels, such that the brightness of display panels basically does not change in the process of displaying images.

Ageing usually takes a long period of time, reduces the productivity, needs certain environment and is inconvenient for operating.

SUMMARY

According to various embodiments disclosed herein, a circuit for ageing display panel is provided.

A circuit for ageing display panel, including an ageing signal input circuit, a power input circuit and a power output circuit is provided herein, in which the ageing signal input circuit and the power input circuit are independently connected to the power output circuit, and the power output circuit is connected to a load;

the ageing signal input circuit is configured to receive an ageing signal and output the ageing signal to the power output circuit;

the power input circuit is configured to provide a supply voltage for the power output circuit; and the power output circuit is configured to output the received supply voltage to the load.

Also provided is a circuit for ageing display panel, including an ageing signal input circuit, a power input circuit, a power output circuit and a signal input control circuit, in which the ageing signal input circuit and the power input circuit are independently connected to the power output circuit, the ageing signal input circuit is connected to the power input circuit, the power output circuit is connected to a load, and the signal input control circuit is connected to the ageing signal input circuit;

the ageing signal input circuit is configured to receive an ageing signal and output the ageing signal to the power output circuit, and can be configured to control an output of the power input circuit; the ageing signal input circuit includes a digital-to-analog amplifying circuit, an ageing signal output circuit and a third switch circuit, the ageing signal output circuit is connected in series between the digital-to-analog amplifying circuit and the third switch circuit, the ageing signal output circuit is further connected to the signal input control circuit, and the third switch circuit is further connected to the power input circuit and the power output circuit;

the power input circuit is configured to provide a supply voltage for the power supply circuit; the power input circuit includes a power supply and a fourth switch circuit, one end of the fourth switch circuit is connected to the power supply, and the other end of the fourth switch circuit is connected to the third switch circuit and the power output circuit;

the power output circuit is configured to output the received supply voltage to a load; the power output circuit includes a first energy storage circuit, a second energy storage circuit, a first switch circuit and a second switch circuit; one end of the first energy storage circuit is connected to the ageing signal input circuit and the power input circuit, and the other end is connected to the first switch circuit and the second switch circuit; one end of the second energy storage circuit is connected to the second switch circuit, and the other end is connected to the load; one end of the first switch circuit is connected to the first energy storage circuit and the second switch circuit, and the other end is grounded; one end of the second switch circuit is connected to the first energy storage circuit and the first switch circuit, and the other end is connected to the second energy storage circuit;

the signal input control circuit is configured to control level shifting of the ageing signal in the ageing signal input circuit.

Further provided is a display panel, including a substrate provided with an off voltage input circuit and a pixel structure, in which the off voltage input circuit is connected to the pixel structure;

the off voltage input circuit includes an ageing signal input circuit, a power input circuit and a power output circuit, the ageing signal input circuit and the power input circuit are independently connected to the power output circuit, and the power output circuit is connected to the pixel structure;

the ageing signal input circuit is configured to receive an ageing signal and output the ageing signal to the power output circuit;

the power input circuit is configured to provide a supply voltage for the power output circuit; and the power output circuit is configured to output the received supply voltage to the pixel structure.

The details of one or more embodiments of the present application are set forth in the accompanying drawings and the description below. Other features and advantages of the present application will be apparent from the specification, drawings and claims.

BRIEF DESCRIPTION OF DRAWINGS

In order to more clearly illustrate the technical solutions of the embodiments of the present application, the drawings required in the description of the embodiments will be briefly described below. Obviously, the drawings in the following description are merely some embodiments of the present application, and those of ordinary skill in the art can obtain other drawings according to the drawings without any inventive labor.

DETAILED DESCRIPTION OF EMBODIMENTS

In order to make the technical solutions and advantages of the present application more clearly understood, the present application is further described in detail below with reference to the accompanying drawings and embodiments. It should be understood that the specific embodiments described herein are merely illustrative of the present application and are not intended to limit the present application.

Figure 1:
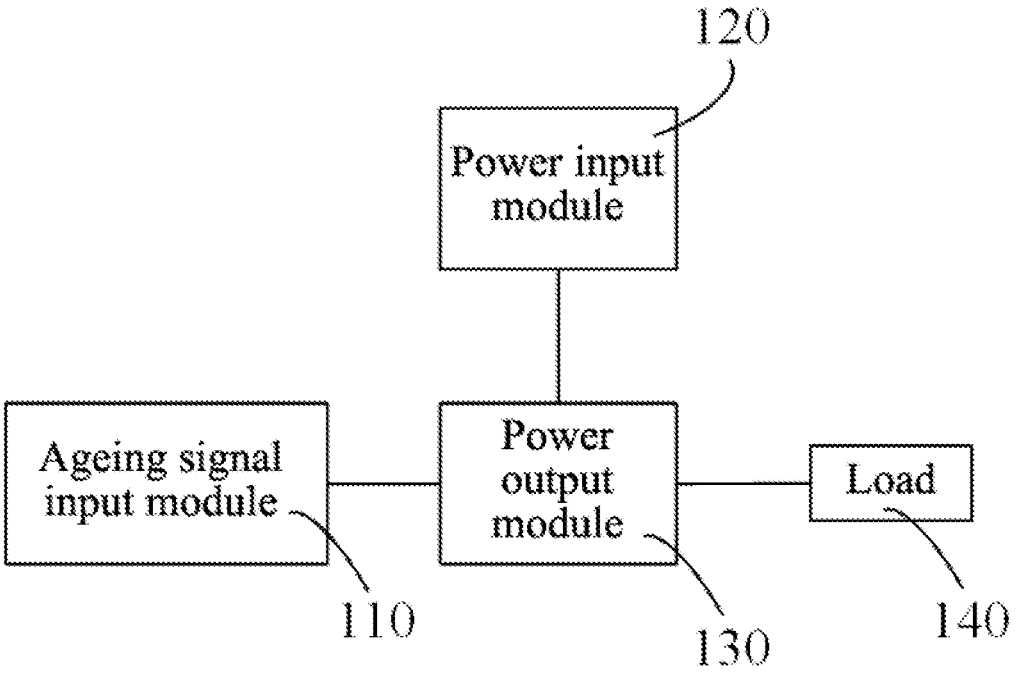
FIG. 1 is a schematic structure diagram of a circuit for ageing in accordance with one or more embodiments.

A circuit for ageing display panel, as shown in FIG. 1, including an ageing signal input circuit 110, a power input circuit 120 and a power output circuit 130 in which the ageing signal input circuit 110 and the power input circuit 120 are independently connected to the power output circuit 130, and the power output circuit 130 is connected to a load 140;

the ageing signal input circuit 110 is configured to receive an ageing signal and output the ageing signal to the power output circuit 130; the power input circuit 120 is configured to provide a supply voltage to the power output circuit 130; the power output circuit 130 is configured to output the received supply voltage to the load 140.

Specifically, when no ageing signal is input into the ageing signal input circuit 110, the power input circuit 120 operates normally, the power input circuit 120 outputs the supply voltage to the load 140 through the power output circuit 130, and the load 140 operates normally. When an ageing signal is input into the ageing signal input circuit 110, the ageing signal input circuit 110 outputs a voltage of the ageing signal to the power output circuit 130, and the power output circuit 130 outputs the supply voltage of the power input circuit 120 and the signal voltage of the ageing signal input circuit 110 to the load 140; at this time, the voltage of the ageing signal is added to the voltage of the power output circuit 130 on the basis of its original voltage, and the value of the off voltage is reduced, such that the difference of voltages input to the load 140 between the on and off states is increased, thereby accelerating the ageing rate of the load 140, i.e., the ageing rate of the display panel. Thus defective display panel products due to reasons such as the manufacturing process and materials can be rejected before shipment, thereby preventing the unqualified products from entering the market.

Figure 2:
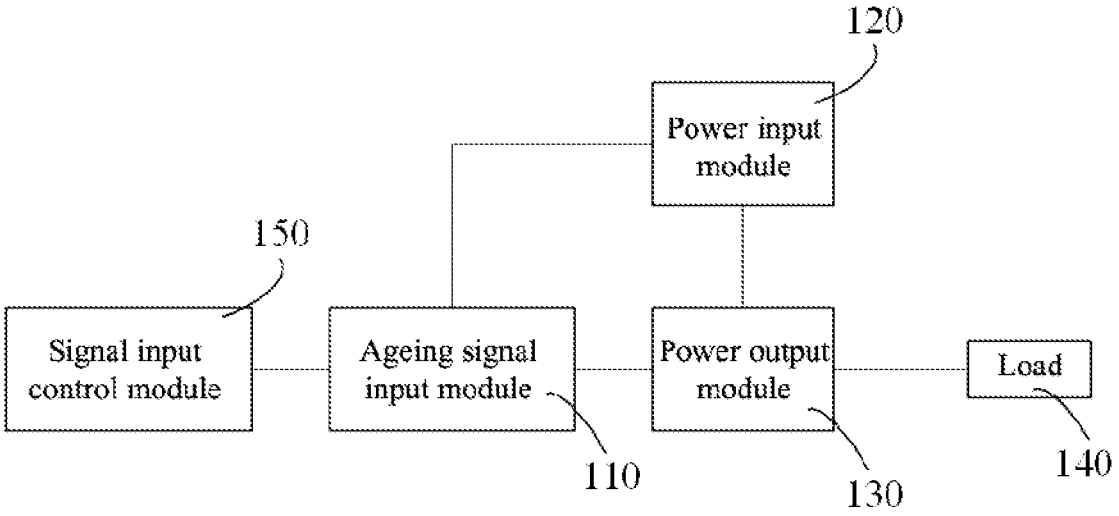
FIG. 2 is a schematic structure diagram of a circuit for ageing in accordance with one or more embodiments.

In one or more embodiments, the ageing signal input circuit 110 is connected to the power input circuit 120, as shown in FIG. 2. The ageing signal input circuit 110 is configured to control an output of the power input circuit 120.

Specifically, when there is no ageing signal input in the ageing input circuit 110, or there is an ageing signal input in the ageing input circuit 110 but the ageing signal is at a low level, the supply voltage in the power input circuit 120 is normally output; when there is an ageing signal input in the ageing input circuit 110 and the ageing signal is at a high level, no supply voltage is output from the power input circuit 120.

In one or more embodiments, as shown in FIG. 2, the circuit for ageing display panel further includes a signal input control circuit 150 connected to the ageing signal input circuit 110. The signal input control circuit 150 is configured to control level shifting of the ageing signal in the ageing signal input circuit 110.

Specifically, the on/off state of the signal input control circuit 150 is controlled by a clock signal.

When no ageing signal is input into the ageing signal input circuit 110, the power input circuit 120 operates normally, the power input circuit 120 outputs the supply voltage to the power output circuit 130, the power output circuit 130 starts to store power and outputs the supply voltage to the load 140, the load 140 operates normally, and the on/off state of the signal input control circuit 150 has no influence on the circuit.

When the ageing signal is input into the ageing signal input circuit 110, the on/off state of the signal input control circuit 150 can control the level shifting of the ageing signal.

When the signal input control circuit 150 is turned on, the ageing signal in the ageing signal input circuit 110 is at a high level, the ageing signal input circuit 110 outputs the voltage of the ageing signal to the power output circuit 130, the power output circuit 130 outputs the supply voltage in the power input circuit 120 and the signal voltage in the ageing signal input circuit 110 to the load 140, and at this time, the voltage of the ageing signal is added to the voltage in the power output circuit 130 on the basis of its original voltage; when the signal input control circuit 150 is turned off, the ageing signal in the ageing signal input circuit 110 is at a low level, and the power output circuit 130 outputs the supply voltage in the power input circuit 120 and the signal voltage in the ageing signal input circuit 110 to the load 140.

The value of the off voltage is reduced, such that the difference of voltages input to the load 140 between the two states of on and off is increased, thereby accelerating the ageing rate of the load 140, i.e., the ageing rate of the display panel. Thus defective display panel products due to reasons such as the manufacturing process and materials can be rejected before shipment, thereby preventing the unqualified products front entering the market.

Figure 3:
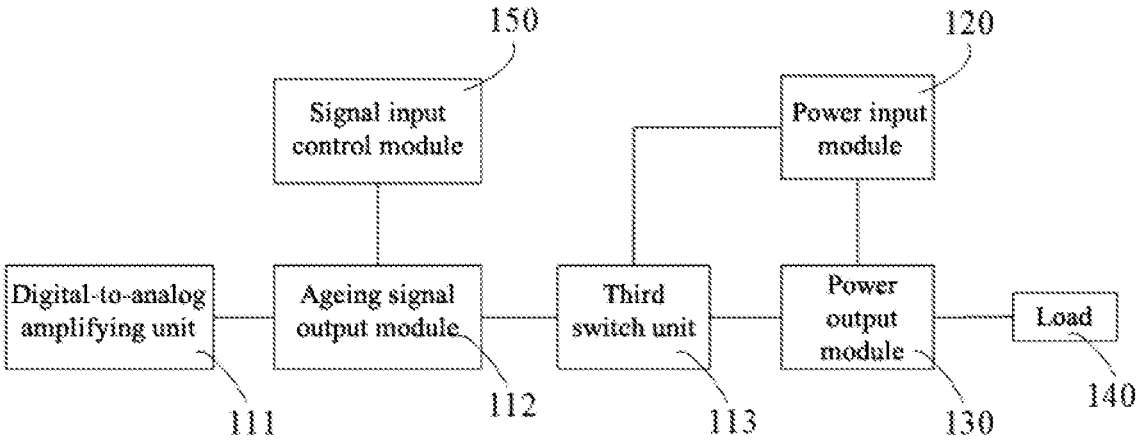
FIG. 3 is a schematic structure diagram of a circuit for ageing in accordance with one or more embodiments.

In one or more embodiments, as shown in FIG. 3, the ageing signal input circuit 110 includes a digital-to-analog amplifying circuit 111 and an ageing signal output circuit 112, in which the ageing signal output circuit 112 is connected in series between the digital-to-analog amplifying circuit 111 and the power output circuit 130, and the ageing signal output circuit 112 is further connected to the signal input control circuit 150.

The digital-to-analog amplifying circuit 111 is configured to convert the ageing signal into an analog signal with a higher voltage.

Specifically, when no ageing signal is input into the ageing signal input circuit 110, the power input circuit 120 operates normally, the power input circuit 120 outputs the supply voltage to the power output circuit 130, the power output circuit 130 starts to store power and outputs the supply voltage to the load 140, the load 140 operates normally, and the ageing signal input circuit 110 has no influence on the circuit.

When an ageing signal is input to the ageing signal input circuit 110, the digital-to-analog amplifying circuit 111 converts the ageing signal into an analog signal, and the ageing signal output circuit 112 outputs the voltage of the ageing signal to the power output circuit 130.

When the signal input control circuit 150 is turned on, the ageing signal in the ageing signal output circuit 112 is at a high level, the digital-to-analog amplifying circuit 111 converts the ageing signal into an analog signal with a higher voltage, the ageing signal output circuit 112 outputs the voltage of the ageing signal to the power output circuit 130, and at this time, the voltage of the ageing signal is added to the voltage in the power output circuit 130 on the basis of its original voltage; when the signal input control circuit 150 is turned off, the ageing signal in the ageing signal output circuit 112 is at a low level, the digital-to-analog amplifying circuit 111 converts the ageing signal into an analog signal with a lower voltage, and the power output circuit 130 outputs the supply voltage in the power input circuit 120 and the signal voltage in the ageing signal input circuit 110 to the load 140.

The value of the off voltage is reduced, such that the difference of voltages input to the load 140 between the two states of on and off is increased, thereby accelerating the ageing rate of the load 140, i.e., the ageing rate of the display panel. Thus defective display panel products due to reasons such as the manufacturing process and materials can be rejected before shipment, thereby preventing the unqualified products from entering the market.

Figure 4:
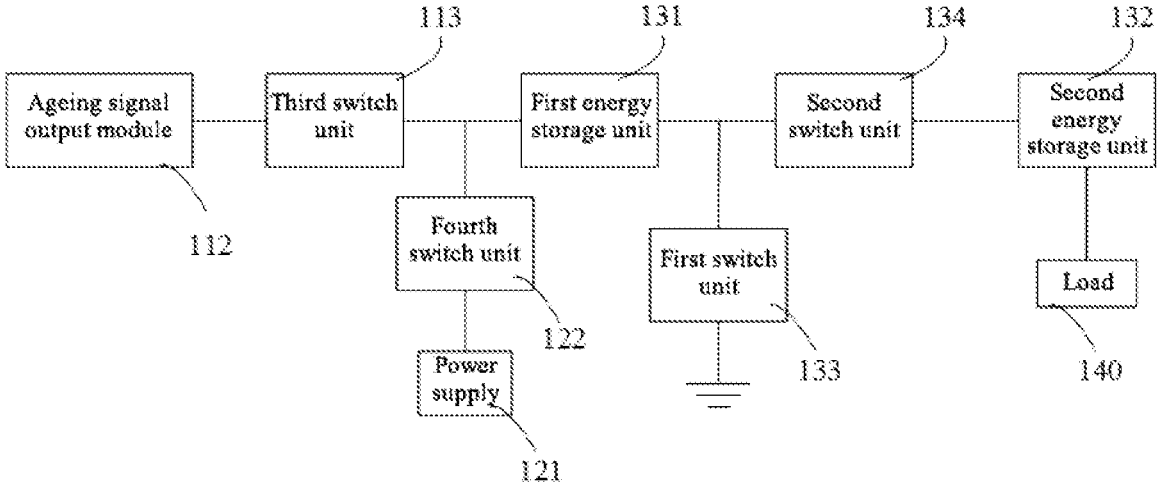
FIG. 4 is a schematic structure diagram of a circuit for ageing in accordance with one or more embodiments.

In one or more embodiments, as shown in FIGS. 3 and 4, the power output circuit 120 includes a first energy storage circuit 131, a second energy storage circuit 132, a first switch circuit 133, and a second switch circuit 134. One end of the first energy storage circuit 131 is connected to the ageing signal input circuit 110 and the power input circuit 120, and the other end is connected to the first switch circuit 133 and the second switch circuit 134; one end of the second energy storage circuit 132 is connected to the second switch circuit 134, and the other end is connected to the load 140; one end of the first switch circuit 133 is connected to the first energy storage circuit 131 and the second switch circuit 134, and the other end is grounded; one end of the second switch circuit 134 is connected to the first energy storage circuit 131 and the first switch circuit 133, and the other end is connected to the second energy storage circuit 134.

The ageing signal input circuit further includes a third switch circuit 113. One end of the third switch circuit 113 is connected to the power output circuit 130 and the power input circuit 120, and the other end is connected to the ageing, signal output circuit 112.

The power input circuit 120 includes a power supply 121 and a fourth switch circuit 122. One end of the fourth switch circuit 122 is connected to the power supply 121, and the other end of the fourth switch circuit 122 is connected to the power output circuit 130 and the ageing signal input circuit. Optionally, the power supply 121 is a pulse power supply.

Specifically, one end of the third switch circuit 113 is connected to the ageing signal output circuit 112, and the other end is connected to the first energy storage circuit 131 and the fourth switch circuit 122; one end of the fourth switch 122 is connected to the third switch circuit 113 and the first energy storage circuit 131, and the other end is connected to the power supply 121; one end of the first energy storage circuit 131 is connected to the third switch circuit 113 and the fourth switch circuit 122, and the other end is connected to the first switch circuit 133 and the second switch circuit 134; one end of the first switch circuit 133 is connected to the first energy storage circuit 131 and the second switch circuit 134, and the other end is grounded; one end of the second switch circuit is connected to the first energy storage circuit 131 and the first switch circuit 133, and the other end is connected to the second energy storage circuit 132; one end of the second energy storage circuit 132 is connected to the second switch circuit 134, and the other end is connected to the load 140.

When no ageing signal is input into the ageing signal input circuit 110, if the power supply 121 is at a high level, the second switch circuit 134 and the third switch circuit 113 are opened, the first switch circuit 133 and the fourth switch circuit 122 are closed, the supply voltage in the power supply 121 is input into the first energy storage circuit 131, and the first energy storage circuit 131 starts to store energy; if the power supply 121 is at a low level, the first switch circuit 133, the third switch circuit 113 and the fourth switch circuit 122 are opened, the second switch circuit 134 is closed, the supply voltage in the first energy storage circuit 131 is inverted and then output to the second energy storage circuit 132, and the second energy storage circuit 132 starts to store energy awl outputs the supply voltage to the load 140.

When an ageing signal is input into the ageing signal input circuit 110 and the ageing signal is at a high level, the fourth switch circuit 122 is opened, the high and low levels of the power supply 121 have no influence on the circuit, the first switch circuit 133 and the third switch circuit 113 are closed, the second switch circuit 134 is opened, the ageing signal output circuit 112 outputs a signal voltage to the first energy storage circuit 131, and the first energy storage circuit 131 starts to store energy.

When an ageing signal is input into the ageing signal input circuit 110 and the ageing signal is at a low level, if the power supply 121 is at a high level, the second switch circuit 134 and the third switch circuit 113 are opened, the first switch circuit 133 and the fourth switch circuit 122 are closed, the supply voltage in the power supply 121 is input into the first energy storage circuit 131, and the first energy storage circuit 131 starts to store energy; if the power supply 121 is at a low level, the first switch circuit 133 is opened, the third switch circuit 113, the fourth switch circuit 122 and the second switch circuit 134 are closed, the supply voltage in the first energy storage circuit 131 is inverted and then output to the second energy storage circuit 132, and the second energy storage circuit 132 starts to store energy and outputs the supply voltage to the load 140.

Optionally, when an ageing signal is input in the ageing signal input circuit 110, a voltage outputting of the power output circuit 130 includes the steps of: the ageing signal in the ageing signal input circuit 110 is at a low level, the supply voltage of the power supply 121 is at a high level, and the first energy storage circuit 131 stores energy; the ageing signal in the ageing signal input circuit 110 is at a high level, the supply voltage of the power supply 121 is at a low level, and the first energy storage circuit 131 continues to store energy; the ageing signal in the ageing signal input circuit 110 and the supply voltage of the power supply 121 are both at low level, at this time, the supply voltage in the first energy storage circuit 131 is inverted and then output to the second energy storage circuit 132, the second energy storage circuit 132 starts to store energy and outputs the supply voltage to the load 140, thereby completing a voltage outputting of the power output circuit 130.

The value of the off voltage is reduced, such that the difference of voltages input to the load 140 between the two states of on and off is increased, thereby accelerating the ageing rate of the load 140, i.e., the ageing rate of the display panel. Thus defective display panel products due to reasons such as the manufacturing process and materials can be rejected before shipment, thereby preventing the unqualified products from entering the market.

The first energy storage circuit 131 and the second energy storage circuit 132 described above may be one or more capacitors connected in series; the first switch circuit 133, the second switch circuit 134, the third switch circuit 113, and the fourth switch circuit 122 may be diodes.

Figure 5:
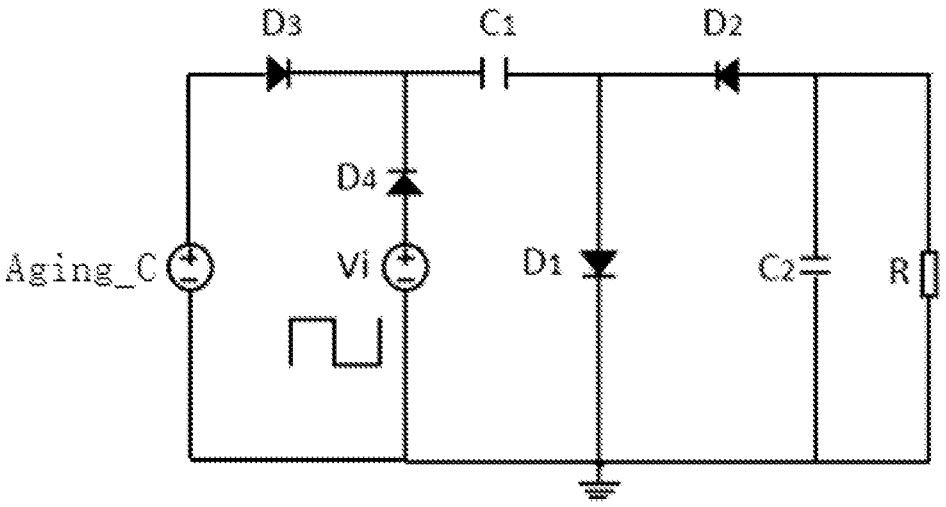
FIG. 5 is a circuit diagram of a circuit for ageing in accordance with one or more embodiments.

In one or more embodiments, as shown in FIG. 5, the first switch circuit 133 is a diode D1, the second switch circuit 134 is a diode D2, the third switch circuit 113 is a diode D3, the fourth switch circuit 122 is a diode D4, the first energy storage circuit 131 is a capacitor C1, the second energy storage circuit 132 is a capacitor C2, and the power supply 121 is a pulse power supply Vi.

Specifically, the anode of the diode D3 is connected to the ageing signal output circuit 112, and the cathode is connected to the capacitor C1 and the cathode of the diode D4; the cathode of the diode D4 is connected to the cathode of the diode D3 and the capacitor C1, and the anode is connected to the pulse power supply Vi; one end of the capacitor C1 is connected to the cathode of the diode D3 and the cathode of the diode D4, and the other end is connected to the anode of the diode D1 and the cathode of the diode D2; the anode of the diode D1 is connected to the capacitor C1 and the cathode of the diode, and the cathode is grounded; the cathode of the diode D2 is connected to the capacitor C1 and the diode D1, and the anode is connected to the capacitor C2; one end of the capacitor C2 is connected to the anode of the diode D2, and the other end is connected to the load 140.

When no ageing signal is input into the ageing signal input circuit 110, if the pulse power supply Vi is at a high level, the diode D2 and the diode D3 are turned off, the diode D1 and the diode D4 are turned on, the supply voltage in the pulse power supply Vi is input into the capacitor C1, and the capacitor C1 starts to store energy; if the pulse power Vi is at a low level, the diode D1, the diode D3 and the diode D4 are turned off, the diode D2 is turned on, the supply voltage in the capacitor C1 is inverted and output to the capacitor C2, the capacitor C2 starts storing power, and the supply voltage is output to the load 140.

When an ageing signal is input into the ageing signal input circuit 110 and the ageing signal is at a high level, the diode D4 is turned off, the high-low level of the pulse power supply Vi has no influence on the circuit, the diode D1 and the diode D3 are turned on, the diode D2 is turned off, the ageing signal output circuit 112 outputs a signal voltage to the capacitor C1, and the capacitor C1 starts to store energy.

When an ageing signal is input into the ageing signal input circuit 110 and the ageing signal is at a low level, if the pulse power supply Vi is at a high level, the diode D2 and the diode D3 are turned off, the diode D1 and the diode D4 are turned on, the supply voltage in the pulse power supply Vi is input into the capacitor C1, and the capacitor C1 starts to store power; if the pulse power Vi is at a low level, the diode D1 is turned off, the diode D3, the diode D4, and the diode D2 are turned on, the supply voltage in the capacitor C1 is inverted and output to the capacitor C2, and the capacitor C2 starts to store power and outputs the supply voltage to the load 140.

When an ageing signal is input in the ageing signal input circuit 110, a voltage outputting of the power output circuit 130 includes the steps of: the ageing signal in the ageing signal input circuit 110 is at a low level, the supply voltage of the pulse power supply Vi is at a high level, and the capacitor C1 stores energy; the ageing signal in the ageing signal input circuit 110 is at a high level, the supply voltage of the pulse power supply Vi is at a low level, and the capacitor C1 continues to store energy; the ageing signal in the ageing signal input circuit 110 and the supply voltage of the pulse power supply Vi are both at low level, at this time, the supply voltage in the capacitor C1 is inverted and then output to the capacitor C2, the capacitor C2 starts to store energy and outputs the supply voltage to the load 140, thereby completing a voltage outputting of the power output circuit 130.

The value of the off voltage is reduced, such that the difference of voltages input to the load 140 between the two states of on and off is increased, thereby accelerating the ageing rate of the load 140, i.e., the ageing rate of the display panel. Thus defective display panel products due to reasons such as the manufacturing process and materials can be rejected before shipment, thereby preventing the unqualified products from entering the market.

Figure 6:
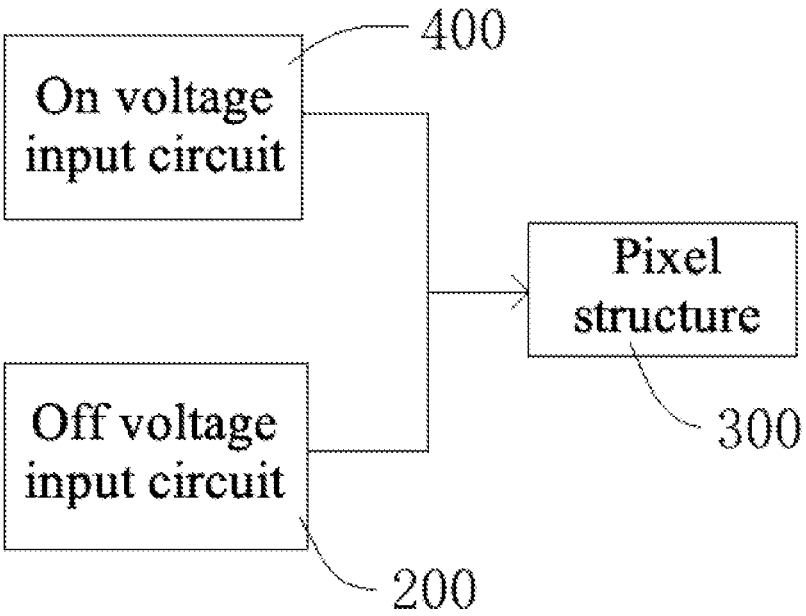
FIG. 6 is a schematic circuit structure diagram of a display panel in accordance with one or more embodiments.
Figure 7:
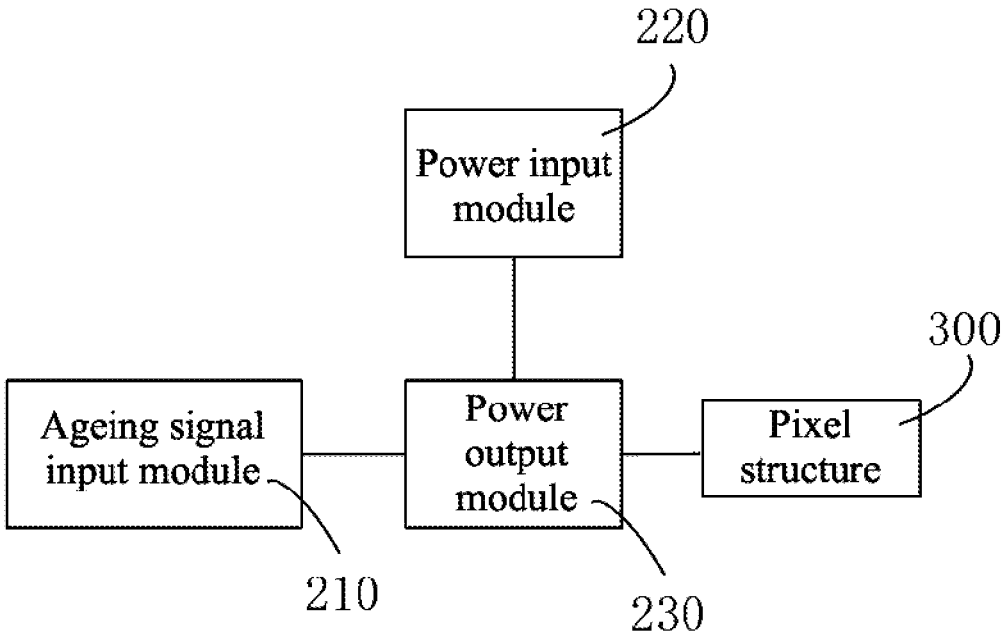
FIG. 7 is a schematic circuit structure diagram of a circuit for ageing in accordance with one or more embodiments.

A display panel including a substrate, as shown in FIGS. 6 and 7, provided with an off voltage input circuit 200, a pixel structure 300 and an on voltage input circuit 400 thereon. The off voltage input circuit 200 and the on voltage input circuit 400 are independently connected to the pixel structure 300, and the on voltage input circuit 400 and the off voltage input circuit 200 are independently connected to the pixel structure 300 to provide on and off voltages for the pixel structure 200.

The off voltage input circuit 200 includes an ageing signal input circuit 210, a power input circuit 220 and a power output circuit 230, the ageing signal input circuit 210 and the power input circuit 220 are independently connected to the power output circuit 230, and the power output circuit 230 is connected to the pixel structure 300.

The ageing signal input circuit 210 is configured to receive an ageing signal and output the ageing signal to the power output circuit 230; the power input circuit 220 is configured to provide a supply voltage to the power output circuit 230; the power output circuit 230 is configured to output the received supply voltage to pixel structure 300.

Specifically, when no ageing signal is input into the ageing signal input circuit 210, the power input circuit 220 operates normally, the power input circuit 220 outputs the supply voltage to the pixel structure 300 through the power output circuit 230, and the pixel structure 300 operates normally. When an ageing signal is input into the ageing signal input circuit 210, the ageing signal input circuit 210 outputs a voltage of the ageing signal to the power output circuit 230, and the power output circuit 230 outputs the supply voltage of the power input circuit 220 and the signal voltage of the ageing signal input circuit 210 to the pixel structure 300; at this time, the voltage of the ageing signal is added to the voltage of the power output circuit 230 on the basis of its original voltage, and the value of the off voltage is reduced, such that the difference of voltages input to the load 300 between the on and off states is increased, thereby accelerating the ageing rate of the pixel structure 300, i.e., the ageing rate of the display panel. Thus defective display panel products due to reasons such as the manufacturing process and materials can be rejected before shipment, thereby preventing the unqualified products from entering the market.

Figure 8:
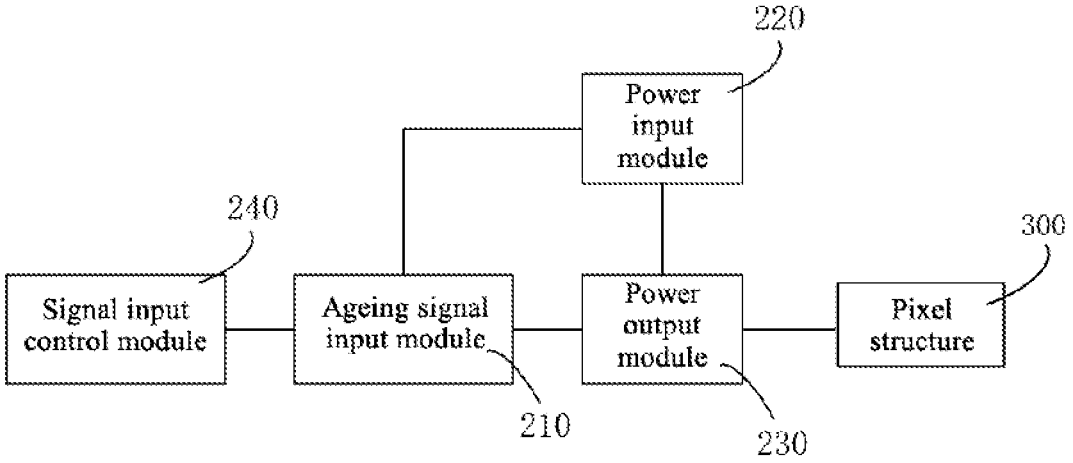
FIG. 8 is a schematic circuit structure diagram of a circuit for ageing in accordance with one or more embodiments.

In one or more embodiments, the ageing signal input circuit 210 is connected to the power input circuit 220, as shown in FIG. 8. The ageing signal input circuit 210 is configured to control an output of the power input circuit 220.

Specifically, when there is no ageing signal input in the ageing input circuit 210, or there is an ageing signal input in the ageing input circuit 210 but the ageing signal is at a low level, the supply voltage in the power input circuit 220 is normally output; when there is an ageing signal input in the ageing input circuit 210 and the ageing signal is at a high level, no supply voltage is output from the power input circuit 220.

In one or more embodiments, as shown in FIG. 8, the circuit for ageing display panel further includes a signal input control circuit 240 connected to the ageing signal input circuit 210. The signal input control circuit 240 is configured to control level shifting of the ageing signal in the ageing signal input circuit 210.

Specifically, the on/off state of the signal input control circuit 240 is controlled by a clock signal.

When no ageing signal is input into the ageing signal input circuit 210, the power input circuit 220 operates normally, the power input circuit 220 outputs the supply voltage to the power output circuit 230, the power output circuit 230 starts to store power and outputs the supply voltage to the pixel structure 300, the pixel structure 300 operates normally, and the on/off state of the signal input control circuit 240 has no influence on the circuit.

When the ageing signal is input into the ageing signal input circuit 210, the on/off state of the signal input control circuit 240 can control the level shifting of the ageing signal.

When the signal input control circuit 240 is turned on, the ageing signal in the ageing signal input circuit 210 is at a high level, the ageing signal input circuit 210 outputs the voltage of the ageing signal to the power output circuit 230, the power output circuit 230 outputs the supply voltage in the power input circuit 220 and the signal voltage in the ageing signal input circuit 210 to the pixel structure 300, and at this time, the voltage of the ageing signal is added to the voltage in the power output circuit 230 on the basis of its original voltage; when the signal input control circuit 240 is turned off, the ageing signal in the ageing signal input circuit 210 is at a low level, and the power output circuit 230 outputs the supply voltage in the power input circuit 220 and the signal voltage in the ageing signal input circuit 210 to the pixel structure 300.

The value of the off voltage is reduced, such that the difference of voltages input to the pixel structure 300 between the two states of on and off is increased, thereby accelerating the ageing rate of the pixel structure 300, i.e., the ageing rate of the display panel. Thus defective display panel products due to reasons such as the manufacturing process and materials can be rejected before shipment, thereby preventing the unqualified products from entering the market.

Figure 9:
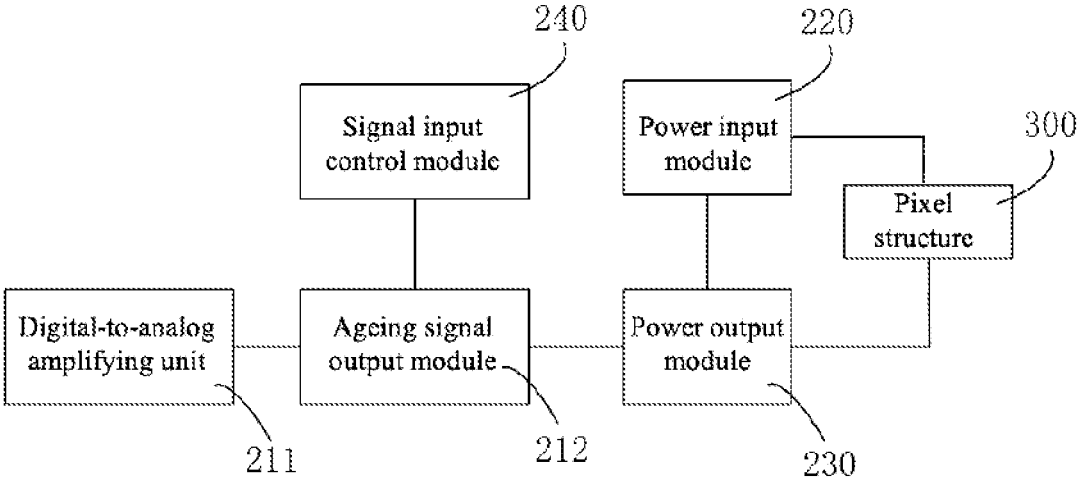
FIG. 9 is a schematic circuit structure diagram of a circuit for ageing in accordance with one or more embodiments.

In one or more embodiments, as shown in FIG. 9, the ageing signal input circuit 210 includes a digital-to-analog amplifying circuit 211 and an ageing signal output circuit 212, in which the ageing signal output circuit 212 is connected in series between the digital-to-analog amplifying circuit 211 and the power output circuit 230, and the ageing signal output circuit 212 is further connected to the signal input control circuit 240.

The digital-to-analog amplifying circuit 211 is configured to convert the ageing signal into an analog signal with a higher voltage.

Specifically, when no ageing signal is input into the ageing signal input circuit 210, the power input circuit 220 operates normally, the power input circuit 220 outputs the supply voltage to the power output circuit 230, the power output circuit 230 starts to store power and outputs the supply voltage to the pixel structure 300, the pixel structure 300 operates normally, and the ageing signal input circuit 210 has no influence on the circuit.

When an ageing signal is input to the ageing signal input circuit 210, the digital-to-analog amplifying circuit 211 converts the ageing signal into an analog signal, and the ageing signal output circuit 212 outputs the voltage of the ageing signal to the power output circuit 230.

When the signal input control circuit 240 is turned on, the ageing signal in the ageing signal output circuit 212 is at a high level, the digital-to-analog amplifying circuit 211 converts the ageing signal into an analog signal with a higher voltage, the ageing signal output circuit 212 outputs the voltage of the ageing signal to the power output circuit 230, and at this time, the voltage of the ageing signal is added to the voltage in the power output circuit 230 on the basis of its original voltage, when the signal input control circuit 240 is turned off, the ageing signal in the ageing signal output circuit 212 is at a low level, the digital-to-analog amplifying circuit 211 converts the ageing signal into an analog signal with a lower voltage, and the power output circuit 230 outputs the supply voltage in the power input circuit 220 and the signal voltage in the ageing signal input circuit 210 to the pixel structure 300.

The value of the off voltage is reduced, such that the difference of voltages input to the pixel structure 300 between the two states of on and off is increased, thereby accelerating the ageing rate of the pixel structure 300, i.e., the ageing rate of the display panel. Thus defective display panel products due to reasons such as the manufacturing process and materials can be rejected before shipment, thereby preventing the unqualified products from entering the market.

Figure 10:
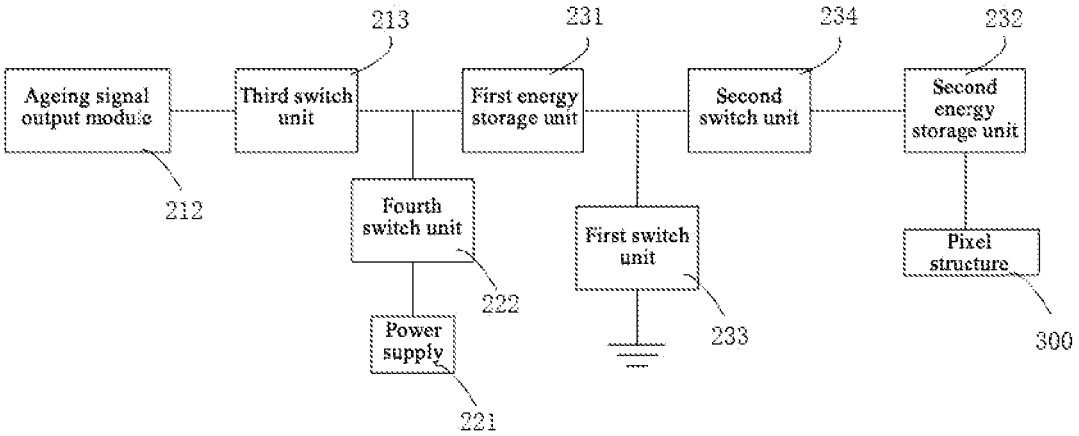
FIG. 10 is a schematic circuit structure diagram of a circuit for ageing in accordance with one or more embodiments.

In one or more embodiments, as shown in FIGS. 9 and 10, the power output circuit 220 includes a first energy storage circuit 231, a second energy storage circuit 232, a first switch circuit 233, and a second switch circuit 234. One end of the first energy storage circuit 231 is connected to the ageing signal input circuit 210 and the power input circuit 220, and the other end is connected to the first switch circuit 233 and the second switch circuit 234; one end of the second energy storage circuit 232 is connected to the second switch circuit 234, and the other end is connected to the pixel structure 300; one end of the first switch circuit 233 is connected to the first energy storage circuit 231 and the second switch circuit 234, and the other end is grounded; one end of the second switch circuit 234 is connected to the first energy storage circuit 231 and the first switch circuit 233, and the other end is connected to the second energy storage circuit 234.

The ageing signal input circuit further includes a third switch circuit 213. One end of the third switch circuit 213 is connected to the power output circuit 230 and the power input circuit 220, and the other end is connected to the ageing signal output circuit 212.

The power input circuit 220 includes a power supply 221 and a fourth switch circuit 222. One end of the fourth switch circuit 222 is connected to the power supply 221, and the other end of the fourth switch circuit 222 is connected to the power output circuit 230 and the ageing signal input circuit. Optionally, the power supply 221 is a pulse power supply.

Specifically, one end of the third switch circuit 213 is connected to the ageing signal output circuit 212, and the other end is connected to the first energy storage circuit 231 and the fourth switch circuit 222; one end of the fourth switch 222 is connected to the third switch circuit 213 and the first energy storage circuit 231, and the other end is connected to the power supply 221; one end of the first energy storage circuit 231 is connected to the third switch circuit 213 and the fourth switch circuit 222, and the other end is connected to the first switch circuit 233 and the second switch circuit 234; one end of the first switch circuit 233 is connected to the first energy storage circuit 231 and the second switch circuit 234, and the other end is grounded; one end of the second switch circuit is connected to the first energy storage circuit 231 and the first switch circuit 233, and the other end is connected to the second energy storage circuit 232; one end of the second energy storage circuit 232 is connected to the second switch circuit 234, and the other end is connected to the pixel structure 300.

When no ageing signal is input into the ageing signal input circuit 210, if the power supply 221 is at a high level, the second switch circuit 234 and the third switch circuit 213 are opened, the first switch circuit 233 and the fourth switch circuit 222 are closed, the supply voltage in the power supply 221 is input into the first energy storage circuit 231, and the first energy storage circuit 231 starts to store energy; if the power supply 221 is at a low level, the first switch circuit 233, the third switch circuit 213 and the fourth switch circuit 222 are opened, the second switch circuit 234 is closed, the supply voltage in the first energy storage circuit 231 is inverted and then output to the second energy storage circuit 232, and the second energy storage circuit 232 starts to store energy and outputs the supply voltage to the pixel structure 300.

When an ageing signal is input into the ageing signal input circuit 210 and the ageing signal is at a high level, the fourth switch circuit 222 is opened, the high and low levels of the power supply 221 have no influence on the circuit, the first switch circuit 233 and the third switch circuit 213 are closed, the second switch circuit 234 is opened, the ageing signal output circuit 212 outputs a signal voltage to the first energy storage circuit 231, and the first energy storage circuit 231 starts to store energy.

When an ageing signal is input into the ageing signal input circuit 210 and the ageing signal is at a low level, if the power supply 221 is at a high level, the second switch circuit 234 and the third switch circuit 213 are opened, the first switch circuit 233 and the fourth switch circuit 222 are closed, the supply voltage in the power supply 221 is input into the first energy storage circuit 231, and the first energy storage circuit 231 starts to store energy; if the power supply 221 is at a low level, the first switch circuit 233 is opened, the third switch circuit 213, the fourth switch circuit 222 and the second switch circuit 234 are closed, the supply voltage in the first energy storage circuit 231 is inverted and then output to the second energy storage circuit 232, and the second energy storage circuit 232 starts to store energy and outputs the supply voltage to the pixel structure 300.

Optionally, when an ageing signal is input in the ageing signal input circuit 210, a voltage outputting of the power output circuit 230 includes the steps of the ageing signal in the ageing signal input circuit 210 is at a low level, the supply voltage of the power supply 221 is at a high level, and the first energy storage circuit 231 stores energy; the ageing signal in the ageing signal input circuit 210 is at a high level, the supply voltage of the power supply 221 is at a low level, and the first energy storage circuit 231 continues to store energy; the ageing signal in the ageing signal input circuit 210 and the supply voltage of the power supply 221 are both at low level, at this time, the supply voltage in the first energy storage circuit 231 is inverted and then output to the second energy storage circuit 232, the second energy storage circuit 232 starts to store energy and outputs the supply voltage to the pixel structure 300, thereby completing a voltage outputting of the power output circuit 230.

The value of the off voltage is reduced, such that the difference of voltages input to the pixel structure 300 between the two states of on and off is increased, thereby accelerating the ageing rate of the pixel structure 300, the ageing rate of the display panel. Thus defective display panel products due to reasons such as the manufacturing process and materials can be rejected before shipment, thereby preventing the unqualified products from entering the market.

The first energy storage circuit 231 and the second energy storage circuit 232 described above may be one or more capacitors connected in series; the first switch circuit 233, the second switch circuit 234, the third switch circuit 213, and the fourth switch circuit 222 may be diodes.

In one or more embodiments, as shown in FIG. 5, the first switch circuit 233 is a diode D1, the second switch circuit 234 is a diode D2, the third switch circuit 213 is a diode D3, the fourth switch circuit 222 is a diode D4, the first energy storage circuit 231 is a capacitor C1, the second energy storage circuit 232 is a capacitor C2, and the power supply 221 is a pulse power supply Vi.

Specifically, the anode of the diode D3 is connected to the ageing signal output circuit 212, and the cathode is connected to the capacitor C1 and the cathode of the diode D4; the cathode of the diode D4 is connected to the cathode of the diode D3 and the capacitor C1, and the anode is connected to the pulse power supply Vi; one end of the capacitor C1 is connected to the cathode of the diode D3 and the cathode of the diode D4, and the other end is connected to the anode of the diode D1 and the cathode of the diode D2; the anode of the diode D1 is connected to the capacitor C1 and the cathode of the diode D2, and the cathode is grounded; the cathode of the diode D2 is connected to the capacitor C1 and the diode D1, and the anode is connected to the capacitor C2; one end of the capacitor C2 is connected to the anode of the diode D2, and the other end is connected to the pixel structure 300.

When no ageing signal is input into the ageing signal input circuit 210, if the pulse power supply Vi is at a high level, the diode D2 and the diode D3 are turned off, the diode D1 and the diode D4 are turned on, the supply voltage in the pulse power supply Vi is input into the capacitor C1, and the capacitor C1 starts to store energy; if the pulse power Vi is at a low level, the diode D1, the diode D3 and the diode D4 are turned off, the diode D2 is turned on, the supply voltage in the capacitor C1 is inverted and output to the capacitor C2, the capacitor C2 starts storing power, and the supply voltage is output to the pixel structure 300.

When an ageing signal is input into the ageing signal input circuit 210 and the ageing signal is at a high level, the diode D4 is turned off, the high-low level of the pulse power supply Vi has no influence on the circuit, the diode D1 and the diode D3 are turned on, the diode D2 is turned off, the ageing signal output circuit 212 outputs a signal voltage to the capacitor C1, and the capacitor C1 starts to store energy.

When an ageing signal is input into the ageing signal input circuit 210 and the ageing signal is at a low level, if the pulse power supply Vi is at a high level, the diode D2 and the diode D3 are turned off, the diode D1 and the diode D4 are turned on, the supply voltage in the pulse power supply Vi is input into the capacitor C1, and the capacitor C1 starts to store power; if the pulse power Vi is at a low level, the diode D1 is turned off, the diode D3, the diode D4, and the diode D2 are turned on, the supply voltage in the capacitor C1 is inverted and output to the capacitor C2, and the capacitor C2 starts to store power and outputs the supply voltage to the pixel structure 300.

Optionally, when an ageing signal is input in the ageing signal input circuit 210, a voltage outputting of the power output circuit 230 includes the steps of: the ageing signal in the ageing signal input circuit 210 is at a low level, the supply voltage of the pulse power supply Vi is at a high level, and the capacitor C1 stores energy; the ageing signal in the ageing signal input circuit 210 is at a high level, the supply voltage of the pulse power supply Vi is at a low level, and the capacitor C1 continues to store energy; the ageing signal in the ageing signal input circuit 210 and the supply voltage of the pulse power supply Vi are both at low level, at this time, the supply voltage in the capacitor C1 is inverted and then output to the capacitor C2, the capacitor C2 starts to store energy and outputs the supply voltage to the pixel structure 300, thereby completing a voltage outputting of the power output circuit 230.

The value of the off voltage is reduced, such that the difference of voltages input to the pixel structure 300 between the two states of on and off is increased, thereby accelerating the ageing rate of the pixel structure 300, i.e., the ageing rate of the display panel. Thus defective display panel products due to reasons such as the manufacturing process and materials can be rejected before shipment, thereby preventing the unqualified products from entering the market.

The technical features of the above embodiments can be combined arbitrarily. For the sake of brevity, all possible combinations of the technical features of the above embodiments are not described, and such combinations of the technical features shall be deemed to fall within the scope of the present disclosure as long as there is no contradiction.

The embodiments above only describe several implementations of the present disclosure, and the description thereof is specific and detailed. However, those cannot be therefore construed as limiting the scope of the disclosure. It should be noted that, for those of ordinary skill in the art, several variations and modifications can be made without departing front the concept of the present disclosure, which also fall within the scope of the present disclosure. Therefore, the protection scope of the present application shall be defined by the appended claims.

What is claimed is:

1. A circuit for ageing display panel comprising an ageing signal input circuit, a power input circuit and a power output circuit, wherein the ageing signal input circuit and the power input circuit independently connect to the power output circuit, and the power output circuit connects to a load;

the ageing signal input circuit is configured to receive an ageing signal and output the ageing signal to the power output circuit;

the power input circuit is configured to provide a supply voltage for the power output circuit; and the power output circuit is configured to output the received supply voltage to the load;

wherein the circuit further comprises a signal input control circuit connected to the ageing signal input circuit; and the signal input control circuit is configured to control level shifting of the ageing signal in the ageing signal input circuit;

wherein the ageing signal input circuit comprises a digital-to-analog amplifying circuit and an ageing signal output circuit, the ageing signal output circuit is connected in series between the digital-to-analog amplifying circuit and the power output circuit, and the ageing signal output circuit is further connected to the signal input control circuit;

wherein the power output circuit comprises a first energy storage circuit, a second energy storage circuit, a first switch circuit, and a second switch circuit;

one end of the first energy storage circuit is connected to the ageing signal input circuit and the power input circuit, and the other end is connected to the first switch circuit and the second switch circuit;

one end of the second energy storage circuit is connected to the second switch circuit, and the other end is connected to the load;

one end of the first switch circuit is connected to the first energy storage circuit and the second switch circuit, and the other end is grounded; and one end of the second switch circuit is connected to the first energy storage circuit and the first switch circuit, and the other end is connected to the second energy storage circuit.

2. The circuit for ageing display panel according to claim 1, wherein the ageing signal input circuit is connected to the power input circuit, and the ageing signal input circuit is configured to control an output of the power input circuit.

3. The circuit for ageing display panel according to claim 1, wherein the ageing signal input circuit further comprises a third switch circuit; one end of the third switch circuit is connected to the power output circuit, and the other end is connected to the ageing signal output circuit.

4. The circuit for ageing display panel according to claim 1, wherein the first energy storage circuit is one or more capacitors connected in series.

5. The circuit for ageing display panel according to claim 1, wherein the second energy storage circuit is one or more capacitors connected in series.

6. The circuit for ageing display panel according to claim 1, wherein the first switch circuit is a diode; the anode of the first switch circuit is connected to the first energy storage circuit and the second switch circuit, and the cathode is grounded.

7. The circuit for ageing display panel according to claim 1, wherein the second switch circuit is a diode; the cathode of the second switch circuit is connected to the first energy storage circuit and the first switch circuit, and the anode is connected to the second energy storage circuit.

8. The circuit for ageing display panel according to claim 3, wherein the third switch circuit is a diode; the anode of the third switch circuit is connected to the ageing signal output circuit, and the cathode is connected to the power output circuit.

9. A display panel, comprising a substrate provided with an off voltage input circuit and a pixel structure, wherein the off voltage input circuit is connected to the pixel structure;

the off voltage input circuit comprises an ageing signal input circuit, a power input circuit and a power output circuit, the ageing signal input circuit and the power input circuit are independently connected to the power output circuit, and the power output circuit is connected to the pixel structure;

the ageing signal input circuit is configured to receive an ageing signal and output the ageing signal to the power output circuit;

the power input circuit is configured to provide a supply voltage for the power output circuit; and the power output circuit is configured to output the received supply voltage to the pixel structure;

wherein the circuit further comprises a signal input control circuit connected to the ageing signal input circuit; and the signal input control circuit is configured to control level shifting of the ageing signal in the ageing signal input circuit;

wherein the ageing signal input circuit comprises a digital-to-analog amplifying circuit and an ageing signal output circuit, the ageing signal output circuit is connected in series between the digital-to-analog amplifying circuit and the power output circuit, and the ageing signal output circuit is further connected to the signal input control circuit;

wherein the power output circuit comprises a first energy storage circuit, a second energy storage circuit, a first switch circuit, and a second switch circuit one end of the first energy storage circuit is connected to the ageing signal input circuit and the power input circuit, and the other end is connected to the first switch circuit and the second switch circuit;

one end of the second energy storage circuit is connected to the second switch circuit, and the other end is connected to the load;

one end of the first switch circuit is connected to the first energy storage circuit and the second switch circuit, and the other end is grounded; and one end of the second switch circuit is connected to the first energy storage circuit and the first switch circuit, and the other end is connected to the second energy storage circuit.

10. The display panel according to claim 9, wherein the substrate is further provided with an on voltage input circuit connected to the pixel structure.

11. The display panel according to claim 9, wherein the ageing signal input circuit comprises a third switch circuit connected to the power input circuit and configured to control an output of the power input circuit.

12. The display panel according to claim 9, wherein the power input circuit comprises a power supply and a fourth switch circuit; one end of the fourth switch circuit is connected to the power supply, and the other end of the fourth switch circuit is connected to the power output circuit.

* * * * *